United States Patent [19]

Aoki et al.

[11] Patent Number: 4,791,041

[45] Date of Patent: Dec. 13, 1988

[54] MAGNETIC CARRIER PARTICLES FOR ELECTROPHOTOGRAPHIC DEVELOPER

[75] Inventors: Takayoshi Aoki; Masayuki Takeda; Chiaki Suzuki; Ikutaroh Nagatsuka, all of Ashigara, Japan

[73] Assignee: Fuji Xerox Co., Ltd., Tokyo, Japan

[21] Appl. No.: 58,421

[22] Filed: Jun. 5, 1987

[30] Foreign Application Priority Data

| | | | |
|---|---|---|---|
| Jun. 5, 1986 | [JP] | Japan | 61-129253 |
| Jun. 16, 1986 | [JP] | Japan | 61-138179 |
| Jun. 16, 1986 | [JP] | Japan | 61-138180 |
| Jun. 16, 1986 | [JP] | Japan | 61-138181 |

[51] Int. Cl.[4] ..... G03G 9/10

[52] U.S. Cl. ..... 430/108; 428/407

[58] Field of Search ..... 430/108; 428/407

[56] References Cited

U.S. PATENT DOCUMENTS

| | | | |
|---|---|---|---|
| 3,526,533 | 9/1970 | Jacknow | 430/137 |
| 3,718,594 | 2/1973 | Miller | 430/137 |
| 3,795,617 | 3/1974 | McCabe | 430/108 X |
| 3,798,167 | 3/1974 | Kulka | 430/108 |
| 3,923,503 | 12/1975 | Hagenbach | 430/108 |
| 3,970,571 | 7/1976 | Olson et al. | 430/110 X |
| 4,051,077 | 9/1977 | Fisher | 430/110 |
| 4,338,390 | 7/1982 | Lu | 430/106 |
| 4,345,014 | 8/1982 | Oka | 430/122 |
| 4,374,192 | 2/1983 | Mayer et al. | 430/108 |
| 4,732,835 | 3/1988 | Katagama et al. | 428/407 X |

FOREIGN PATENT DOCUMENTS

| | | |
|---|---|---|
| 13954 | 4/1972 | Japan . |
| 66134 | 8/1979 | Japan . |

*Primary Examiner*—J. David Welsh

*Attorney, Agent, or Firm*—Sughrue, Mion, Zinn, Macpeak & Seas

[57] ABSTRACT

A carrier for developer is disclosed, which comprises a core having an average particle size of from 50 to 200 μm and comprising fine magnetic particles dispersed in a binder resin and a polymer overcoat having a critical surface tension of from 10 to 25 dyn/cm formed on the surface of the core. The carrier has improved chargeability, high resistance to surface soiling, and high mechanical strength.

19 Claims, No Drawings

MAGNETIC CARRIER PARTICLES FOR ELECTROPHOTOGRAPHIC DEVELOPER

FIELD OF THE INVENTION

The present invention relates to a carrier for use in development of a latent electrostatic image in electrophotography or electrostatic recording. More particularly, the present invention relates to a carrier for use in magnetic brush development that comprises a fine magnetic powder and a binder resin and which has improved chargeability, high resistance to surface soiling, high mechanical strength, prolonged developer life, and a capability of faster development.

BACKGROUND OF THE INVENTION

Electrophotographic processing is commonly performed by the following procedures: a latent electrostatic image is formed by various electrical means on a photoreceptor made of selenium or some other suitable photoconductive materials; and toner particles are deposited on the latent image by a suitable method of development such as magnetic brush method so as to produce a visible image.

In the development step, carrier particles are used in order to impart an appropriate amount of positive or negative electrical charges to the toner. Various types of carriers have so far been developed and used commercially.

While carriers are required to possess various characteristics, particularly important ones include appropriateness of the plurality of charges generated by electrification, high impact and wear resistance, efficiency in development, and long developer life. In these respects, the prior art carriers still have problems to be solved and an product having satisfactory characteristics has not yat been achieved. For example, iron oxide powders and other electrically conductive carriers are capable of producing solid developed images of high quality but are not equally effective in reproducing fine lines of good quality. Furthermore, they require a special charge control agent to be incorporated in the toner in order to extend the life of the developer. Developers using coated carriers (i.e., with an insulation coating) have an extended life and a capability of reproducing fine lines of good quality but they are ineffective in reproduction of solid developed images of high quality. With a view to solving these problems, carriers consisting of small-diameter particles in which fine magnetic particles are dispersed in a binder resin have been proposed and commercialized, as described in U.S. Pat. No. 4,345,014 and Japanese Patent Application (OPI) No. 66134/79 (the term "OPI" as used herein means "unexamined published application"). However, this is not a complete solution to the problem of the shortness of developer life because: small-diameter carrier particles have a great tendency to adhere to the surface of the photoreceptor, their chargeability varies depending upon the moisture content of the environment in which they are used, and they are not highly amenable to effective surface treatment.

SUMMARY OF THE INVENTION

An object, of the present invention is to provide a novel carrier for use in magnetic brush development of a latent electrostatic image in electrophotography or electrostatic recording.

Another object of the present invention relates to a carrier for use in magnetic brush development that is free from the problem of decrease in the amount of charges during the course of running operation because of its high resistance to surface soiling and in turn neither causing any fogging at the early stage of operation nor fouling the interior of a copying or recording machine, and that has the additional advantages such as prolonging the life of the developer and allowing for rapid development.

As a result of intensive studies to eliminate the aforementioned defects of the prior art carriers, the present inventors has now found it effective to use a carrier wherein a polymer overcoat having a specified value of critical surface tension is formed on the surface of core having an average size (diameter) of from about 50 to about 200 μm and comprising fine magnetic particles dispersed in a binder resin. A developer using this carrier achieves as good reproduction of fine lines as can be attained from the conventional small-diameter carrier and yet retains the advantage of large-diameter carrier, namely, anti-adhesion of carrier particles to the surface of the photoreceptor. The present invention has been accomplished on the basis of this finding.

Thus, the present invention provides a carrier for developer which comprises a core having an average size of from about 50 to about 200 μm and comprising fine magnetic particles dispersed in a binder resin and a polymer overcoat having a critical surface tension of from about 10 to about 25 dyn/cm formed on the surface of the core.

DETAILED DESCRIPTION OF THE INVENTION

The binder resin for the core of the carrier of the present invention is not limited to any particular material and may be selected from various materials having suitable chargeability. Examples of the materials include addition polymer resins such as homo- or copolymers of styrene, acrylic, olefinic, diene, acrylonitrile, acrylamide, vinyl acetate, or halogenated olefin monomers; polycondensation compounds such as polyesters, polyamides, polycarbonates, and silicone polymers; cellulose resins; and polyaddition compounds such as epoxy and polyurethane resins. Of these binder resins, styrene polymers, acrylic polymers, and copolymers of a styrene monomer and an acrylic monomer are preferably used. When these polymers or copolymers are used in amounts of 50 wt% or more, preferably 70 wt% or more, based on the total weight of the binder resins for the core, they do not react even under heating conditions in peparation of the core, e.g., during melt blending of materials for the core, so that heat characteristics of the binder resin are not deteriorated, and the resulting carrier has high charge stability in humid condition.

The styrene polymer used in the present invention is either a homo- or copolymer of a styrene monomer. Specific examples of the styrene monomer include styrene and derivatives thereof such as alkylstyrenes (e.g., methylstyrene, dimethylstyrene, trimethylstyrene, ethylstyrene, diethylstyrene, triethylstyrene, propylstyrene, butylstyrene, hexylstyrene, heptylstyrene, and octylstyrene), halogenated styrenes (e.g., fluorostyrene, chlorostyrene, bromostyrene, dibromostyrene, and iodostyrene), as well as nitrostyrene, acetylstyrene, and methoxystyrene. The alkylstyrenes preferably have the alkyl moiety of from 1 to 4 carbon atoms.

These styrene monomers may be used either independently or in admixture. They may, as desired, be used in combination with one or more monomers that are copolymerizable with them. In this case, styrene monomers are preferably contained in an amount of 25 wt% or more, more preferably 50 wt% or more, and most preferably 70 wt% or more, based on the total amount of the monomers constituting the binder resin for the core.

Illustrative monomers that are copolymerizable with styrene monomers are esters of acrylic or methacrylic acid with alcohols, preferably having from 1 to 10 carbon atoms, such as alkyl alcohols, halogenated alkyl alcohols, alkoxyalkyl alcohols, aralkyl alcohols, and alkenyl alcohols. More specific examples of the alcohols that form esters with acrylic or methacrylic acid are listed below: alkyl alcohols such as methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol, hexadecyl alcohol; halogenated alkyl alcohols wherein these alkyl alcohols are partially halogenated; alkoxyalkyl alcohols such as methoxyethyl alcohol, ethoxyethyl alcohol, ethoxyethoxyethyl alcohol, methoxypropyl alcohol, and ethoxypropyl alcohol; aralkyl alcohols such as benzyl alcohol, phenylethyl alcohol, and phenylpropyl alcohol; and alkenyl alcohols such as allyl alcohol and crotonyl alcohol.

Other copolymerizable monomers are addition polymerizable unsaturated carboxylic acids including unsaturated aliphatic monocarboxylic acids such as acrylic acid, methacrylic acid, $\alpha$-ethylacrylic acid, crotonic acid, $\alpha$-methylcrotonic acid, $\alpha$-ethylcrotonic acid, isocrotonic acid, tiglic acid, and ungelicaic acid; and unsaturated aliphatic dicarboxylic acids such as maleic acid, furmaric acid, itaconic acid, citraconic acid, mesaconic acid, glutaconic acid, and dihydromuconic acid.

Metal salts of these carboxylic acids are also usable and conversion to metal salts may be effected after completion of the polymerization of monomers.

Other copolymerizable monomers are esters of the above-listed addition polymerizable unsaturated carboxylic acids with alcohols such as alkyl alcohols, halogenated alkyl alcohols, alkoxyalkyl alcohols, aralkyl alcohols, and alkenyl alcohols.

Still other copolymerizable monomers include amides and nitriles derived from the aforementioned addition polymerizable unsaturated carboxylic acids; aliphatic monoolefins such as ethylene, propylene, butene, and isobutylene; halogenated aliphatic olefins such as vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride, and vinylidene fluoride; and conjugated diene-based aliphatic diolefins such as 1,3-butadiene, 1,3-pentadiene, 2-methyl-1,3-butadiene, 2,3-dimethyl-1,3-butadiene, 2,4-hexadiene, and 3-methyl-2,4-hexadiene. These copolymerizable monomers may be used either independently or in combination with themselves.

Other useful comonomers include vinyl acetate compounds, vinyl ethers, and nitrogen-containing vinyl compounds such as vinylcarbazole, vinylpyridine, and vinylpyrrolidone.

The acrylic polymer which is useful as a binder resin in the present invention is a homo- or copolymer of an acrylic or methacrylic acid ester. Specific examples of the monomer of which these acrylic polymers can be formed are those esters of acrylic or methacrylic acid with alcohols such as alkyl alcohols, halogenated alkyl alcohols, alkoxyalkyl alcohols, aralkyl alcohols and alkenyl alcohols which are already listed as comonomers that may be used in the preparation of the styrene polymer.

These acrylic monomers may be used either alone or in admixture. They may, as desired, be used in combination with one or more monomers that are copolymerizable with them. In this case, acrylic monomers are preferably contained in an amount of 25 wt% or more, more preferably 50 wt% or more, and most preferably 70 wt% or more, based on the total amount of the monomers constituting the binder resin for the core.

Illustrative monomers that are copolymerizable with acrylic monomers include styrene, derivatives thereof, addition polymerizable unsaturated carboxylic aids, metal salts thereof, esters of addition polymerizable unsaturated carboxylic acids with alcohols, amides, and nitrile derivatives of addition polymerizable unsaturated carboxylic acids, aliphatic monoolefins, halogenated aliphatic olefins, conjugated diene-based aliphatic diolefins, and nitrogen-containing vinyl monomers, as described above.

A fluorine or silicone polymer may be used as the polymer overcoat that has a critical surface tension of from about 10 to about 25 dyn/cm and which forms the surface layer of the carrier of the present invention. Those having the critical surface tension of from 10 to 22 dyn/cm are preferably used. When the critical surface tension is more than 25 dyn/cm, the life of the resulting developer is markedly deteriorated and further the developer cannot attain good reproduction of fine lines.

The term "critical surface tension" is described in detail in *Fukugo Zairyo Kogaku* (*Composite Material Engineering*), published by Nikkagiren Shuppan, pp. 148–153 (September, 1971), and it is determined by the following manner: contact angles ($\theta$) of various kinds of liquid having different surface tensions ($\gamma$L) are measured on a test material using a contact angle measuring apparatus (CA-D type, produced by Kowa Kaimen Kagaku Co.); the surface tension ($\gamma$L) and the contact angle ($\theta$) or the value of cos $\theta$ of each liquid are plotted to obtain a straight line, a so-called Zisman plot; and then the surface tension at $\theta=0$ or cos $\theta=1$ is obtained by extrapolation of the Zisman plot, which is defined as critical surface tension.

A fluorine polymer may be composed of fluorinated alkylene monomers generally having from 2 to 10 carbon atoms and preferably from 2 to 5 carbon atoms, such as tetrafluoroethylene, trifluoromethyltrifluoroethylene, heptafluoropropylethylene, and 1-[(1-trifluoromethyltetrafluoroethoxy)methyl]-1-methylethylene, or fluorinated acrylic monomers generally having from 3 to 25 carbon atoms, preferably from 5 to 17 carbon atoms, and more preferably from 7 to 15 carbon atoms, such as fluorinated alkyl acrylates and methacrylates. Fluorinated acrylic monomers are preferred in view of copolymerizability with other monomers and solubility in solvents.

Illustrative fluorinated alkyl acrylates or methacrylates that can be used in the present invention include esters of acrylic acid or methacrylic acid with alcohols, such as perfluorohexylethyl, perfluorooctylethyl, 1,1-dihydroperfluoroethyl, 1,1-dihydroperfluoropropyl, 1,1-dihydroperfluorohexyl, 1,1-dihydroperfluorooctyl, 1,1-dihydroperfluorodecyl, 1,1-dihydroperfluorolauryl, 1,1,2,2-tetrahydroperfluorobutyl, 1,1,2,2-tetrahydroperfluorohexyl, 1,1,2,2-tetrahydroperfluorooctyl, 1,1,2,2-tetrahydroperfluorodecyl, 1,2,2,2-tetrahydroperfluorolauryl, 1,1,2,2-tetrahydroperfluorostearyl, 2,2,3,3-tetrafluoropropyl, 2,2,3,3,4,4-hexafluorobutyl, 1,1,ω-trihydroperfluorohexyl, 1,1,ω-trihydroperfluorooctyl, 1,1,1,3,3,3-hexafluoro-2-chloro-propyl, 3-perfluorononyl-2-acetylpropyl, 3-perfluorolauryl-2-acetylpropyl, N-perfluorohexylsulfonyl-N-methylaminoethyl, N-perfluorohexylsulfonyl-N-butylaminoethyl, N-perfluorooctylsulfonyl-N-methylaminoethyl, N-perfluorooctylsulfonyl-N-ethylaminoethyl, N-perfluorooctylsulfonyl-N-butylaminoethyl, N-perfluorodecylsulfonyl-N-methylaminoethyl, N-perfluorodecylsulfonyl-N-ethylaminoethyl, N-perfluorodecylsulfonyl-N-butylaminoethyl, N-perfluorolaurylsulfonyl-N-methylaminoethyl, N-perfluorolaurylsulfonyl-N-ethylaminoethyl, and N-perfluorolaurylsulfonyl-N-butylaminoethyl.

These fluorinated alkyl acrylates or methacrylates may be copolymerized with components that are selected from the already listed comonomers for the formation of acrylic polymers, and they include styrene monomers; addition polymerizable unsaturated carboxylic acids; esters of addition polymerizable unsaturated carboxylic acids with alcohols such as alkyl alcohols, alkoxyalkyl alcohols wherein alkyl alcohols are partially alkoxylated, aralkyl alcohols, and alkenyl alcohols (with alkyl esters of acrylic, methacrylic, fumaric or maleic acid being particularly preferable); amide or nitrile derivatives of addition polymerizable unsaturated carboxylic acids; aliphatic monoolefins; halogenated aliphatic olefins; conjugated diene-based aliphatic diolefins; and nitrogen-containing vinyl monomers such as 2-vinylpyridine, 4-vinylpyridine, 2-vinyl-6-methylpyridine, 2-vinyl-5-methylpyridine, 4-butenylpyridine, 4-pentylpyridine, N-vinylpiperidiene, 4-vinylpiperidine, N-vinyldihydropyridine, N-vinylpyrrole, 2-vinylpyrrole, N-vinylpyrroline, N-vinylpyrrolidine, 2-vinylpyrrolidine, N-vinyl-2-pyrrolidone, N-vinyl-2-piperidone, and N-vinylcarbazole. These comonomers may be used either independently or in admixture.

The fluorinated alkyl acrylate or methacrylate is preferably contained in an amount of from 5 to 80 wt%, more preferably from 10 to 50 wt%, based on the total amount of monomers constituting the polymer overcoat.

Any of the magnetic particles that are conventionally used as ferromagnetic materials can be used in the present invention, and illustrative examples are the particles of magnetite, gamma-hematite, red oxide, chromium oxide, nickel, manganese, iron, cobalt, and nickel alloyls. These magnetic particles generally have an average particle size of from 0.5 to 5 μm, and preferably from 0.1 to 1 μm. The magnetic particles generally occupy from 30 to 95 wt%, preferably from 45 to 90 wt%, of all the components of the carrier including the core and the overcoat.

In preparing the carrier particles of the present invention, fine magnetic particles and a binder resin are blended under heating, and the resulting mixture is finely divided, optionally spheroidized under heating, to attain particles having a desired size; alternatively, a binder resin is dissolved in an appropriate solvent (i.e., one capable of solubilizing the binder resin) and the resulting solution is mixed with fine magnetic particles to form a slurry, which is granulated and dried with a spray dryer, followed by optional spheroidization, to attain particles having a desired size; and then the so obtained particles are coated with a polymer (i.e., fluorine polymer or silicone polymer) having a critical surface tension of not more than 25 dyn/cm.

The spheroidization may be effected by injecting particles composed of the binder resin and the fine magnetic powder into a heated air atmosphere such that the surface temperature of the particles becomes from 10° to 30° C. higher than the glass transition temperature of the binder resin and recovering them just before agglomeration of the particles takes place, followed by cooling.

A thin and continuous polymer overcoat can be formed by applying a solution of the polymer to the core. A fluidized bed coating method is preferably employed so as to provide a uniform and continuous overcoat on the core. In this method, the core particles are suspended or circulated in heated air flowing upwardly and spray-coated with a solution of the polymer, and the coated core particles are then sedimented in air stream with a less air flow speed wherein the solvent is evaporated to form a polymer overcoat on the core. The temperature of the fluidized bed is varied depending on the kind of solvents, and it is generally from 20° to 30° C. lower than the boiling point of the solvent used.

The polymer overcoat is preferably applied in an amount of from 0.005 to 3.0 wt%, more preferably from 0.05 to 2.5 wt%, of the core. The overcoat preferably has a thickness of from 0.05 to 5.0 μm so as to protect the core and to aid the triboelectrification of toner particles.

When a fluorinated alkyl acrylate or methacrylate polymer is used for the polymer overcoat, the carrier particles of the present invention can also be produced without applying the coating of the polymer onto the core because the polymer has a very low surface free energy. One method using this approach consists of blending a binder resin and a fine magnetic powder (both being intended to make a core) and a fluorinated alkyl acrylate or methacrylate polymer under heating, and grinding the mix into particles which are then spheroidized. In another method, a binder resin for making a core and a fluorinated alkyl acrylate or methacrylate polymer are dissolved in a solvent and the resulting solution is mixed with a fine magnetic powder to make a slurry, which is then granulated and dried with a spray dryer and spheroidized. In either of these methods, the fluorinated alkyl acrylate or methacrylate polymer will spontaneously form a polymer overcoat, thereby readily producing the intended carrier particles of a dual structure without employing any special coating techniques.

In another aspect, the present invention provides a carrier for developer having an average particle size of from about 50 to about 200 μm which has fine magnetic particles dispersed in a binder resin mainly composed of a copolymer containing a fluorinated alkyl acrylate monomer component. To be more specific, the fluorinated copolymer is generally contained in an amount of 50 wt% or more, preferably 75 wt% or more, based on the total weight of the binder resin.

The fluorinated alkyl acrylate monomer used in the binder resin for producing a carrier according to this second aspect of the present invention may be the fluorinated alkyl acrylate or methacrylate as described above. These monomers are compolymerized with one or more of the comonomers that are used in forming the polymer overcoat of the carrier in accordance with the first aspect of the present invention. The content of the fluorinated alkyl acrylate monomer in the copolymer is generally from 5 to 50 wt%, preferably from 10 to 40 wt%, based on the total amount of monomers constituting the copolymer.

The copolymer of the fluorinated alkyl acrylate monomer may be used in admixture with a variety of polymers such as polymers (including copolymers) of the already described addition polymerizable monomers. Also usable are the polyamides, polyesters, polycarbonates, silicone resins, cellulose resins and other polycondensation resins that have been listed above as the binder resins for making a core.

The carrier according to the second aspect of the present invention which is composed of magnetic particles and a binder resin can also be produced by a variety of methods as already described in connection with the first aspect. In one method, the resin is mixed with magnetic particles in a molten state by means of a suitable device such as a Banbury mixture, a kneader, a roll mill, or an extruder, and the resulting blend is cooled, ground into particles and classified for a desired size. Another method is the "spray drying" process in which magnetic particles are dispersed in a resin solution and the resulting dispersion is spray-dried to form particles. An alternative method is the "suspension polymerization process" in which the components such as monomers and resin content that are necessary for making a binder resin are dispersed in a suitable solvent and the resulting suspension is polymerized to make a desired carrier. The particle size of the carrier can also be adjusted by various methods such as by controlling the conditions for grinding the molten mix of components, or by classifying the ground particles to attain a desired size, or mixing a plurality of carriers having different particle size distributions so as to attain a carrier having a desired particle size distribution.

The carrier according to the second aspect of the present invention may be immediately used as carrier particles. If desired, the carrier particles may be surface-treated or coated with an appropriate material such as a resin, a coupling agent, a surfactant, a charge control agent, or a fine powder. In either case, the carrier particles are preferably spheroidized to attain spherical particles.

In order to attain a balance between the life of the developer, anti-adhesion of carrier particles to the surface of the photoreceptor, and the image quality attainable, the carrier particles to be produced in accordance with the present invention have an average size of from about 50 to about 200 μm, and preferably from about 60 to about 150 μm.

The so prepared carrier of the present invention is mixed with a toner and used as a developer for rendering a latent electrostatic image visible by the magnetic brush method. The toner may be of any type that is conventionally employed in electrophotography as described, for example, in U.S. Pat. Nos. 2,659,670, 2,753,308, 3,070,342, and 2,788,288 and which has a colorant dispersed in a binder resin. Typical examples of the binder resin include polymer or copolymer of styrene monomers, acrylic acid, methacrylic acid or esters thereof, polyesters, polyamides, styrene-butadiene copolymers, and the like. Typical examples of the colorant include carbon black, azo-based pigments and dyes, phthalocyanine pigments, and the like. Further, a charge controlling agent and other additives conventionally used may also be added.

In the present invention, a toner consisting of carbon black and a binder resin is preferably used to prolong the life of the resulting developer. Further, a negatively chargeable toner can be preferably formed with carbon black having a pH of 4 or higher and a binder resin containing more than 50 wt% of styrene as a monomer component.

Any development methods capable of using a two-component type developer can be applied in the present invention, such as magnetic brush development and cascade development, and a development system with a rotary nonmagnetic column sleeve having placed therein a fixed magnet roll is particularly preferred so as to prevent adhesion of the carrier to a photoreceptor.

Various photoreceptors can be used in the present invention, such as PVK-TNF type organic photoreceptors, laminate type organic photoreceptors containing azo dyes, squarine pigments or phthalocyanine pigments, and amorphous silicon photoreceptors, as well as positively chargeable photoreceptors, e.g., Se, Se-Te or Se-As-Te type photoreceptors, with Se-Te type photoreceptors being preferably used.

The carrier of the present invention for use in the development of a latent electrostatic image by the magnetic brush method has the following advantages: it can be rapidly electrified and yet will experience no significant drop in quality of charges generated during the course of running operation, so that fogging does not take place in the early stage of operation and the interior of the copying or recording machine is not fouled; in addition to its high mechanical strength, it has a coating layer of a material having a low surface energy and has a low bulk density and thus exhibits such a high resistance to surface soiling by the toner that its life and, hence, the life of the developer will be substantially extended; and additionally, it provides for rapid development on account of its low permeability.

The following examples are provided for the purpose of further illustrating the present invention but the present invention is not limited thereto.

EXAMPLE 1

Thirty parts by weight of a copolymer of methyl methacrylate and styrene (80/20 by weight; weight average molecular weight about $7\times10^4$) and 70 parts by weight of a fine magnetic iron oxide powder (EPT-1000, produced by Toda Kogyo Co.) were mixed under heating, and the resulting mixture was ground into particles which were then classified to make core particles having an average particle size of 100 μm.

In a separate step, 0.5 parts by weight of a copolymer of perfluorohexylethyl methacrylate and styrene (50/50 by weight; weight average molecular weight about $1\times10^4$; critical surface tension 18 dyn/cm) was dissolved in 20 parts by weight of trifluorotrichloroethane. Using a fluidized bed coating apparatus, the resulting solution was coated on 80 parts by weight of the previously formed core particles.

The resulting particles were sieved to form a carrier (sample No. 1) within the scope of the present invention that had an average particle size of 100 μm and a size distribution of from 53 to 200 μm.

The performance of this carrier was evaluated together with three comparative carriers: sample No. 2 that was an insulated carrier having an average particle size of 90 μm which was prepared by coating a CuZn ferrite core with the same copolymer as used for the polymer overcoat of sample No. 1; sample No. 3 that was an electrically conductive carrier which was composed of iron oxide particles having an average size of 100 μm; and sample No. 4 that was a small carrier having an average particle size of 25 μm which had the same composition as that of sample No. 1 and prepared by first blending the two copolymers and the magnetic powder in a molten state, then grinding the blend into particles which were subsequently classified for the indicated size.

The toner used in making developers was solely composed of 90 wt% of a styrene-butyl methacrylate copolymer (weight ratio: 65/35) and 10 wt% of carbon black (BP-1300, produced by Cabot Co.; pH 2.5) and had an average particle size of 11 μm. This toner content in the developer was 10 wt% when the small carrier was mixed to make a developer. For preparing developers from the other carriers, the toner content was 3 wt%.

The four developer samples were subjected to a copying test using a copier (FX-5870, produced by Fuji Xerox Co., Ltd.) with the speeds of the photoreceptor and the developing magnetic roll (sleeve) set at 350 mm/sec and 550 mm/sec, respectively, so as to evaluate their initial performance (viz., the quantity of charges generated, the density of solid images, the fog density at the background, the reproduction of fine lines, and anti-adhesion of carrier particles to the surface of the photoreceptor) and the performance after $5\times10^4$ runs (viz., the quantity of charges generated, the density of solid images, the fog density at the background, and the reproduction of fine lines). The same copying test was conducted both under humid conditions (30° C. and 80%RH) and under dry conditions (10° C. and 30%RH).

The quantity of charges generated was measured according to a blow-off method. The density of solid images and the fog density at the background were measured using a densitometer, Macbeth RD-517 produced by Macbeth Co., with reference to a gray scale produced by Eastman Kodak Co.

The reproduction of fine line was evaluated as follows: A (capable of reproducing fine lines of 175 lines/inch), B(capable of reproducing fine lines of 133 lines/inch but not of 175 lines/inch), and C (incapable of reproducing fine lines of 133 lines/inch).

The anti-adhesion of carrier particles to photoreceptor was measured in terms of the amount of carrier particles adhered to the surface area of a photoreceptor corresponding to an A4-size paper after development of a predetermined pattern.

The test results are shown in Table 1, from which the superiority of the carier prepared in accordance with the present invention is seen.

TABLE 1

| | Initial performance | | | | | | |
|---|---|---|---|---|---|---|---|
| Sample No. | Carrier type | Content (wt %) | Quantity of charges generated (μc/g) | Density of solid image | Fog density at background | Reproduction of fine lines | Antiadhesion of carrier particles to photoreceptor (mg) |
| 1 | invention | 3 | 14 | 1.5 | 0.00 | A | 0.2 |
| 2 | insulated | 3 | 15 | 0.8 | 0.00 | A | 0.2 |
| 3 | conductive | 3 | 16 | 1.2 | 0.00 | C | 0.7 |
| 4 | small type | 10 | Unmeasurable by blow-off method | 1.4 | 0.00 | B | 1.1 |

| | After $5\times10^4$ runs | | | | | Environment test | |
|---|---|---|---|---|---|---|---|
| Sample No. | Quantity of charges generated (μc/g) | Density of solid image | Fog density at background | Reproduction of fine lines | Life (runs) | Under summer condition (30° C., 80% RH) | Under winter condition (10° C., 30% RH) |
| 1 | 14 | 1.3 | 0.00 | A | $>5\times10^4$ | good | good |
| 2 | 13 | 0.6 | 0.01 | B | $5\times10^4$(1) | good | fair(3) |
| 3 | 8 | 0.8 | 0.10 | C | $1\times10^4$ | poor(2) | fair(3) |
| 4 | Unmeasurable by blow-off method | 0.9 | 0.04 | B | $4\times10^4$ | poor(2) | poor(4) |

(1)All copies had low density.
(2)Fogging took place.
(3)Images of low density were obtained.
(4)Carrier particles adhered to photoreceptor.

EXAMPLE 2

Thirty parts by weight of a copolymer of methyl methacrylate, styrene and dimethylaminoethyl methacrylate (80/18/2 by weight; weight average molecular weight about $3\times10^4$) and 70 parts by weight of a fine magnetic iron oxide powder (EPT-1000) were mixed under heating. The blend was heated to 150° C. and the resulting melt was treated with cold air and reduced to fine particles with a spray dryer to make core particles having an average particle size of 150 μm. In a separate step, 0.5 parts by weight of a copolymer of 1,1,2,2-tetrahydroperfluorohexyl methacrylate and styrene (20/80 by weight; weight average molecular weight about $3\times10^4$; critical surface tension 18 dyn/cm) was dissolved in 20 parts by weight of trifluorotrichloroethane. Using a fluidized bed coating apparatus, the resulting solution was coated on 80 parts by weight of the previously formed core particles.

The resulting particles were sieved to form a carrier (sample No. 5) within the scope of the present invention that had an average particle size of 150 μm and a size distribution of from 63 to 250 μm.

As in Example 1, the performance of this carrier was evaluated together with two comparative carriers: sample No. 6 that was an insulated carrier having an average particle size of 90 μm which was prepared by coating a CuZn ferrite core with the same copolymer as used for the polymer overcoat of sample No. 5; and sample No. 7 that was a small carrier having an average particle size of 25 μm which had the same composition as that of sample No. 5 and prepared by first blending the copolymers and the magnetic powder in a molten state, then grinding the blend into particles which were subsequently classified for the indicated size.

The results of the evaluations conducted are summarized in Table 2, from which the superiority of the carrier prepared in accordance with the present invention is clearly seen.

TABLE 2

| | Initial performance | | | | | | |
|---|---|---|---|---|---|---|---|
| Sample No. | Carrier type | Content (wt %) | Quantity of charges generated (μc/g) | Density of solid image | Fog density at background | Reproduction of fine lines | Antiadhesion of carrier particles to photoreceptor (mg) |
| 5 | invention | 3 | 17 | 1.3 | 0.00 | A | 0.1 |
| 6 | insulated | 3 | 19 | 0.6 | 0.00 | A | 0.1 |
| 7 | small type | 10 | Unmeasurable by blow-off method | 1.4 | 0.00 | B | 1.1 |

| | After $5 \times 10^4$ runs | | | | | Environment test | |
|---|---|---|---|---|---|---|---|
| Sample No. | Quantity of charges generated (μc/g) | Density of solid image | Fog density at background | Reproduction of fine lines | Life (runs) | Under summer condition (30° C., 80% RH) | Under winter condition (10° C., 30% RH) |
| 5 | 13 | 1.1 | 0.00 | A | $>5 \times 10^4$ | good | good |
| 6 | 20 | 0.5 | 0.02 | B | $5 \times 10^4$(1) | good | fair(3) |
| 7 | Unmeasurable by blow-off method | 0.9 | 0.04 | B | $4 \times 10^4$ | poor(2) | poor(4) |

(1)All copies had low density.
(2)Fogging took place.
(3)Images of low density were obtained.
(4)Carrier particles adhered to photoreceptor.

EXAMPLE 3

Thirty parts by weight of a copolymer of methyl methacrylate and styrene (80/20 by weight; weight average molecular weight about $7 \times 10^4$), 70 parts by weight of a fine magnetic iron oxide powder (EPT-1000) and 10 parts by weight of a copolymer of N-perfluorohexylsulfonyl-N-butylaminoethyl methacrylate and methyl methacrylate (40/60 by weight; weight average molecular weight about $5 \times 10^3$; critical surface tension 20 dyn/cm) were blended under heating and resulting mixture was ground into particles and classified. The classified particles having an average particle size of 85 μm were spheroidized and given a dual structure by treatment with a thermal spheroidizing apparatus.

The resulting particles were sieved to form a carrier (sample No. 8) within the scope of the present invention that had an average particle size of 85 μm and a size distribution of from 53 to 200 μm.

As in Example 1, the performance of this carrier was evaluated together with two comparative carriers: sample No. 9 that was an insulated carrier having an average particle size of 90 μm which was prepared by coating a CuZn ferrite core with the same copolymer as used for the polymer overcoat of sample No. 8; and sample No. 10 that was a small carrier having an average particle size of 25 μm which had the same composition as that of sample No. 8 and was prepared by first blending the copolymers and the magnetic powder in a molten state, then grinding the blend into particles which were subsequently classified for the indicated size.

The results of the evaluations conducted are summarized in Table 3, from which one can see the superiority of the carrier prepared in accordance with the present invention.

TABLE 3

| | Initial performance | | | | | | |
|---|---|---|---|---|---|---|---|
| Sample No. | Carrier type | Content (wt %) | Quantity of charges generated (μc/g) | Density of solid image | Fog density at background | Reproduction of fine lines | Antiadhesion of carrier particles to photoreceptor (mg) |
| 8 | invention | 3 | 15 | 1.4 | 0.00 | A | 0.1 |
| 9 | insulated | 3 | 18 | 0.9 | 0.00 | A | 0.1 |
| 10 | small type | 10 | Unmeasurable by blow-off method | 1.4 | 0.00 | B | 1.1 |

| | After $5 \times 10^4$ runs | | | | | Environment test | |
|---|---|---|---|---|---|---|---|
| Sample No. | Quantity of charges generated (μc/g) | Density of solid image | Fog density at background | Reproduction of fine lines | Life (runs) | Under summer condition (30° C., 80% RH) | Under winter condition (10° C., 30% RH) |
| 8 | 18 | 1.2 | 0.00 | A | $>5 \times 10^4$ | good | good |

TABLE 3-continued

| | | | | | | | |
|---|---|---|---|---|---|---|---|
| 9 | 19 | 0.5 | 0.00 | B | $5 \times 10^4$(1) | good | fair(3) |
| 10 | Unmeasurable by blow-off method | 0.8 | 0.04 | B | $4 \times 10^4$ | poor(2) | poor(4) |

(1)All copies had low density.
(2)Fogging took place.
(3)Images of low density were obtained.
(4)Carrier particles adhered to photoreceptor.

EXAMPLE 4

Thirty parts by weight of a copolymer of methyl methacrylate, styrene and perfluorooctylethyl methacrylate (80/10/10 by weight; weight average molecular weight about $3 \times 10^4$) and 80 parts by weight of a fine magnetic iron oxide powder (EPT-1000) were mixed under heating and the resulting mixture was ground into particles. The particles were then left to stand in a dryer at 70° C. for 24 hours. The dried powder was sieved to obtain a carrier (sample No. 11) within the scope of the present invention that had an average particle size of 80 μm and a size distribution of from 53 to 150 μm. The critical surface tension of the carrier was 18 dyn/cm.

As in Example 1, the performance of this carrier was evaluated together with two comparative carriers: sample No. 12 that was an insulated carrier having an average particle size of 90 μm which was prepared by coating a CuZn ferrite core with the same copolymer as used in sample No. 11; and sample No. 13 that was a small carrier having an average particle size of 25 μm which had the same composition as that of sample No. 11 and was prepared by first blending the copolymer with a magnetic powder in a molten state, then grinding the blend into particles which were subsequently classified for the indicated size.

The toner used in making developers was the same as in Example 1 but the toner content in the developer was changed from 3 wt% to 5 wt% when the carriers other than the small carrier were used.

The results of the evaluations conducted are summarized in Table 4, from which the superiority of the carrier prepared in accordance with the present invention is seen.

TABLE 4

| | Initial performance | | | | | | |
|---|---|---|---|---|---|---|---|
| Sample No. | Carrier type | Content (wt %) | Quantity of charges generated (μc/g) | Density of solid image | Fog density at background | Reproduction of fine lines | Antiadhesion of carrier particles to photoreceptor (mg) |
| 11 | invention | 5 | 14 | 0.5 | 0.00 | A | 0.1 |
| 12 | insulated | 5 | 15 | 0.7 | 0.00 | A | 0.1 |
| 13 | small type | 10 | Unmeasurable by blow-off method | 1.5 | 0.00 | B | 1.1 |

| | After $5 \times 10^4$ runs | | | | | Environment test | |
|---|---|---|---|---|---|---|---|
| Sample No. | Quantity of charges generated (μc/g) | Density of solid image | Fog density at background | Reproduction of fine lines | Life (runs) | Under summer condition (30° C., 80% RH) | Under winter condition (10° C., 30% RH) |
| 11 | 13 | 0.4 | 0.00 | A | $>5 \times 10^4$ | good | good |
| 12 | 10 | 0.5 | 0.02 | B | $5 \times 10^4$(1) | good | fair(3) |
| 13 | Unmeasurable by blow-off method | 0.9 | 0.06 | B | $4 \times 10^4$ | poor(2) | poor(4) |

(1)All copies had low density.
(2)Fogging took place.
(3)Images of low density were obtained.
(4)Carrier particles adhered to photoreceptor.

While the invention has been described in detail and with reference to specific embodiments thereof, it will be apparent to one skilled in the art that various changes and modifications can be made therein without departing from the spirit and scope thereof.

What is claimed is:

1. A carrier for developer which comprises a core having an average particle diameter of from about 50 to about 200 μm and comprising magnetic particles having an average particle size of from 0.05 to 5 μm dispersed in a binder resin, and a polymer overcoat having a critical surface tension of from about 10 to about 25 dyn/cm and comprising a fluorinated alkylacrylate or methacrylate copolymer, formed on the surface of the core.

2. A carrier according to claim 1, wherein said binder resin is mainly composed of a styrene polymer and said overcoat comprises a fluorinated alkyl acrylate or methacrylate copolymer.

3. A carrier according to claim 1, wherein said binder resin is mainly composed of an acrylic polymer and said overcoat is formed of a fluorinated alkyl acrylate or methacrylate copolymer.

4. A carrier for developer having an average particle size of from about 50 to about 200 μm which comprises magnetic particles dispersed in a binder resins that is mainly composed of a copolymer containing a fluorinated alkyl acrylate or methacrylate as a monomer component.

5. A carrier according to claim 1, wherein said polymer overcoat has a critical surface tension of from 10 to 22 dyn/cm.

6. A carrier according to claim 1, wherein said polymer overcoat comprises a fluorine polymer containing a monomer component selected from the group consisting of fluorinated alkylene monomers having from 2 to 10 carbon atoms and fluorinated acrylic monomers having from 3 to 25 carbon atoms.

7. A carrier according to claim 6, wherein said fluorinated acrylic monomers are fluorinated alkyl acrylates or methacrylates.

8. A carrier according to claim 7, wherein said fluorinated alkyl acrylate or methacrylate is contained in an amount of from 5 to 80 wt% based on the total amount of monomers constituting the polymer overcoat.

9. A carrier according to claim 8, wherein said fluorinated alkyl acrylate or methacrylate is contained in an amount of from 10 to 50 wt% based on the total amount of monomers constituting the polymer overcoat.

10. A carrier according to claim 4, wherein said copolymer is contained in an amount of 50 wt% or more based on the total amount of the binder resin.

11. A carrier according to claim 10, wherein said copolymer contains from 5 to 50 wt% of the fluorinated alkyl acrylate or methacrylate monomer.

12. A carrier according to claim 11, wherein said copolymer contains from 10 to 40 wt% of the fluorinated alkyl acrylate or methacrylate monomer.

13. A carrier according to claim 4, wherein said magnetic particles have an average particle size of from 0.05 to 5 μm.

14. A carrier according to claim 1, wherein said magnetic particles occupy from 30 to 95 wt% of all the components of the carrier.

15. A carrier according to claim 4, wherein said magnetic particles occupy from 30 to 95 wt% of all the components of the carrier.

16. A carrier according to claim 1, wherein said polymer overcoat has a thickness of from 0.05 to 5.0 μm.

17. A developer comprising a toner composed of a pigment and a binder resin, and a carrier which comprises a core having an average particle diameter of from about 50 to about 200 μm and comprising magnetic particles dispersed in a binder resin and a polymer overcoat having a critical surface tension of from about 10 to about 25 dyn/cm formed on the surface of the core.

18. A developer comprising a toner composed of a pigment and a binder resin, and a carrier having an average particle size of from about 50 to about 200 μm which comprises magnetic particles dispersed in a binder resins that is mainly composed of a copolymer containing a fluorinated alkyl acrylate or methacrylate as a monomer component.

19. The developer as in claim 17, wherein the magnetic particles have an average particle size of from 0.05 to 5 μm and the polymer overcoat comprises a fluorinated alkylacrylate or methacrylate copolymer.

* * * * *